United States Patent [19]

Taylor

[11] 4,011,041

[45] Mar. 8, 1977

[54] TOBACCO CURING AND DRYING APPARATUS

[75] Inventor: John S. Taylor, Jacksonville, Fla.

[73] Assignee: Tifcon Company, Lenox, Ga.

[22] Filed: June 16, 1975

[21] Appl. No.: 587,158

[52] U.S. Cl. ..... 432/21; 432/176; 432/222; 432/500; 131/140 B

[51] Int. Cl.[2] ..... F26B 3/02; A24B 1/02

[58] Field of Search ..... 432/500, 19, 168, 167, 432/172, 176, 186, 189, 192, 223, 222, 21; 34/212, 221; 131/140 R

[56] References Cited

UNITED STATES PATENTS

| | | | |
|---|---|---|---|
| 2,343,346 | 3/1944 | Touton | 34/221 |
| 2,551,215 | 5/1951 | Lytton | 432/176 |
| 2,985,438 | 5/1961 | Prowler | 432/223 |
| 3,109,637 | 11/1963 | Taylor | 432/172 |
| 3,881,863 | 5/1975 | Creuz | 432/222 |
| 3,910,757 | 10/1975 | Taylor et al. | 432/500 |

*Primary Examiner*—John J. Camby
*Assistant Examiner*—Henry C. Yuen
*Attorney, Agent, or Firm*—Ira Milton Jones and Associates

[57] ABSTRACT

Leaf tobacco or the like in a substantially airtight enclosure is cured and dried by circulating through the enclosure air that is controllably heated by a forced air fuel burner located in an elongated vertically oriented duct outside the enclosure. The outlet end of the duct is communicated with the enclosure at the bottom thereof, and its upper inlet end is controllably communicable with the enclosure at the top thereof and with the ambient atmosphere. The air intake port of the fuel burner receives only air flowing through the duct. Air circulation is effected by an electric motor driven fan near the inlet of the duct, and a restriction in the duct produces a pressure drop across the burner that prevents back-drafts through it.

15 Claims, 5 Drawing Figures

6
8
12
7
18
7a
17
19
16
15
21
21
7
20
14
21
21
9
9
22
26
13
25
29
28
27
23
37
5
31
30
5
9
31
24
32
33
35
34
10
36
7b
11

TOBACCO CURING AND DRYING APPARATUS

This invention relates to the curing and drying of leaf tobacco and other products that can be dried by subjecting them to a moving stream of controllably heated air. Accordingly, this invention is classifiable with that of the Taylor U.S. Pat. No. 3,109,637.

While the tobacco curing apparatus of the Taylor patent was a vast improvement over prior curing and drying facilities, the present invention constitutes a further very substantial improvement over that of the Taylor patent, particularly in that equipment embodying the present invention is significantly lower in operating cost and achieves far more efficient utilization of combustible fuel and electric power, to thus attain a marked saving in energy consumption.

As in the Taylor patent, the products to be cured and/or dried by means of the method and apparatus of this invention are placed in a substantially airtight enclosure or barn through which air is positively circulated. The air entering the enclosure can be controlled as to temperature and relative humidity, and, after flowing over and through the products in the enclosure, it is either entirely discharged into the atmosphere, completely recirculated, or is partially discharged and partially recirculated.

In the apparatus of the Taylor patent, a fuel burner was located in a duct that had its inlet selectively communicable with a heated air outlet in the top of the enclosure or with the ambient atmosphere. A blower was located in the duct, directly downstream from the fuel burner, to suck air from the inlet of the duct and past the fuel burner, then force the heated air into the enclosure through air outlets in the duct that were located in the bottom of the enclosure. This arrangement had the serious disadvantage that the blower was acting upon the most highly heated air in the apparatus — that which had just been drawn across the fuel burner — and therefore the blower was operating under conditions that made for the most inefficient utilization of the power applied to movement of the air.

It was of course appreciated that blower efficiency could have been markedly improved if the blower had been located directly upstream from the fuel burner, where air temperatures were at the lowest level for the entire apparatus. However, the location of the air circulation blower upstream from the fuel burner involved a complication that was regarded as insurmountable. The heat that the fuel burner added to the airstream flowing through the duct greatly increased the pressure of the air downstream from the fuel burner, raising its pressure substantially above that of the ambient atmospheric air at the fuel burner air intake, which was outside the duct, in the ambient atmosphere.

This adverse pressure gradient across the fuel burner would have greatly decreased its capacity. Furthermore, the fuel burner of a curing and drying apparatus operates intermittently, under thermostatic control, and at every shut-down of the burner, the heated, high pressure air in its combustion area would have forced its way through the burner and out into the atmosphere, wastefully carrying with it the high latent heat of the combustion area, and sooner or later probably damaging the burner.

To avoid this back draft problem without substantial sacrifice of efficiency of the air circulating blower, it was customary, where a liquid fuel (oil) burner was located downstream from an air circulating blower, to conduct the products of combustion from the burner through a heat exchanger and thence to a stack from which they were vented to the atmosphere. Back drafts were thus avoided by isolating the products of combustion from the air being circulated through the enclosure, and the heat of the combustion gases was of course given up to the circulating air at the heat exchanger.

However, the gain in blower efficiency that was obtained by this arrangement was offset — or more than offset — by a loss in fuel utilization efficiency. The heat exchanger could not effect a 100% heat transfer from the combustion gases to the circulating air. A new unit of the type just described wasted about 20% of the heat available from the fuel, and after a relatively short period of use the heat loss increased to about 35%.

It is a general object of the present invention to avoid the notably poor blower efficiency that was obtained with the prior arrangement in which an air circulating blower was located downstream from the fuel burner, to avoid the back draft problem that discouraged placement of the burner downstream of the air circulating blower, and to avoid the marked waste of available fuel heat that attended the operation of prior apparatus in which the combustion products of a fuel burner were passed through a heat exchanger in indirect heat transfer relationship with air to be circulated through a curing and drying enclosure.

In accordance with the present invention, the air circulating blower and the fuel burner are both located in an elongated duct that has an inlet end portion which is communicable with an air outlet in a drying enclosure or barn and has an outlet end portion communicated with an air inlet of the enclosure. The air circulating blower is located in a portion of the duct that is upstream from the fuel burner and not only recirculates heated air from the enclosure, but also causes fresh air to be drawn into the duct through a controllable fresh air inlet to replace any heated air that may have been exhausted from the enclosure through a controllable vent therein. The blower is thus operating upon the lowest temperature air in the entire apparatus and can therefore function with optimum efficiency.

Two important features of the invention are primarily responsible for its ability to avoid the above explained back draft problem.

First, the fuel burner is located wholly within the duct in which the blower is located, so that all of the air which flows through the fuel burner is also flowing through the duct and hence has been acted upon by the blower. Since the blower continues to operate when the burner shuts down, a positive movement of air through the burner is ensured by the blower, and such air movement is of course in the direction to oppose a back draft.

Second, the fuel burner is provided with a combustion chamber which is so arranged as to cooperate with the duct in defining a throttling restriction therein. The air intake of the fuel burner is upstream from this throttling restriction; its combustion zone is downstream from the restriction. The restriction therefore cooperates with the blower to produce a pressure drop across the burner such that the pressure difference between the burner air intake and the burner combustion zone further opposes any tendency towards development of a back draft through the burner.

The increase in burner effiency obtained by this arrangement has resulted in fuel savings of as much as 25% compared to heretofore conventional oil-fired tobacco curers and of approximately 33% as compared to prior equipment fired with L.P. gas.

It follows, therefore, that it is a major purpose and object of this invention to achieve a very significant reduction in the energy consumption required for curing and drying a given quantity of a product such as leaf tobacco.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

The accompanying drawings illustrate two complete examples of embodiments of the invention constructed according to the best modes so far devised for the practical application of the principles thereof, and in which.

Figure 4:
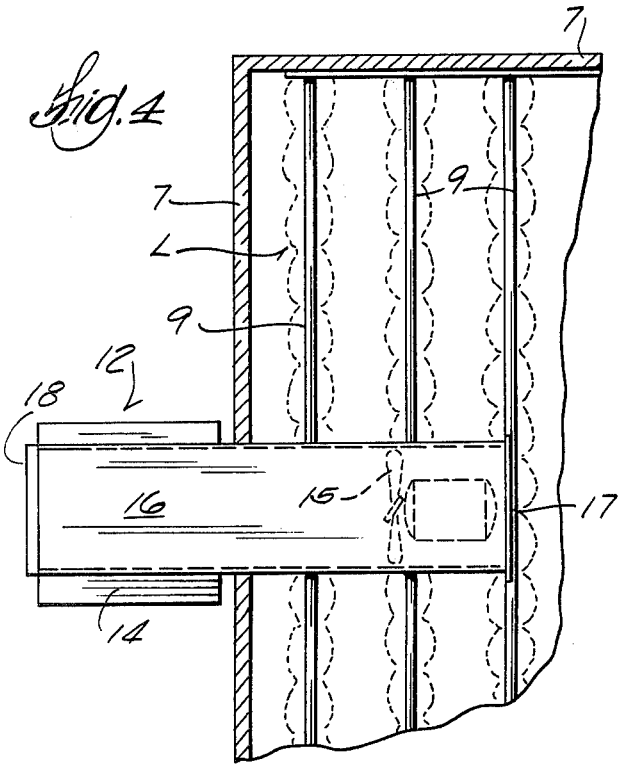
Figure 5:
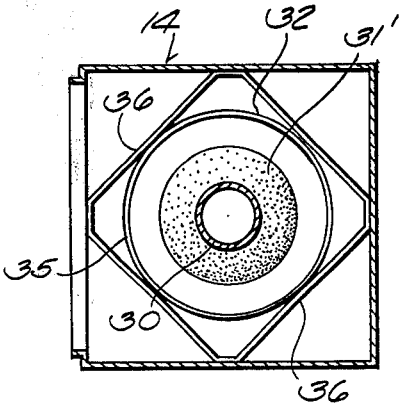
Figure 2:
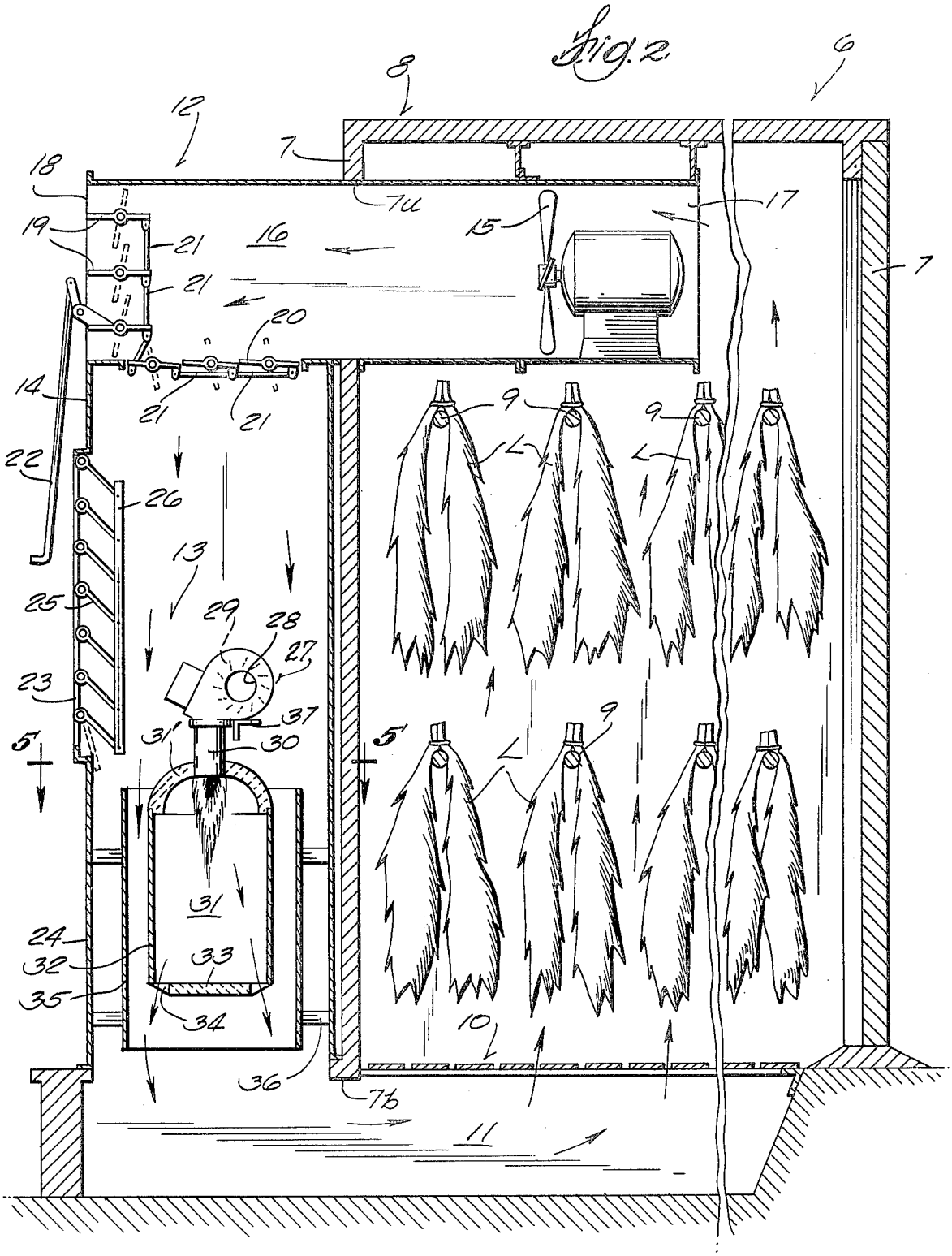
FIG. 2 is a vertical sectional view through the tobacco curing barn and its associated curing and drying apparatus.

FIG. 4, on Sheet 1, is a fragmentary horizontal sectional view through the barn; and FIG. 5, also on Sheet 1, is a view in horizontal cross section, taken through FIG. 2 on the plane of the line 5—5.

Referring now to the accompanying drawings, the numeral 6 designates generally a curing barn which may be of any desired type of construction, with upright walls 7 and a roof 8 that is preferably pitched so as to localize the upper interior of the barn.

The product L to be cured and/or dried — in this case leaf tobacco — is arranged in the barn in such a way that it is uniformly distributed in planes perpendicular to the flow of air circulated through the barn. Since the air enters the barn at the bottom and leaves at the top, the flow is substantially vertical and the plane or planes on which the leaves are uniformly distributed are horizontal.

The specific manner of supporting the tobacco leaves is not important, so long as heavy layers of leaves do not lie flatwise across the path of the rising air. For purposes of illustration, the tobacco leaves have been shown hanging in bunches from poles 9.

A slotted or perforated floor 10 that forms the bottom of the barn interior also defines a plenum space 11 at its underside which horizontally distributes the air before it enters the barn through the slots or perforations in the floor.

Figure 1:
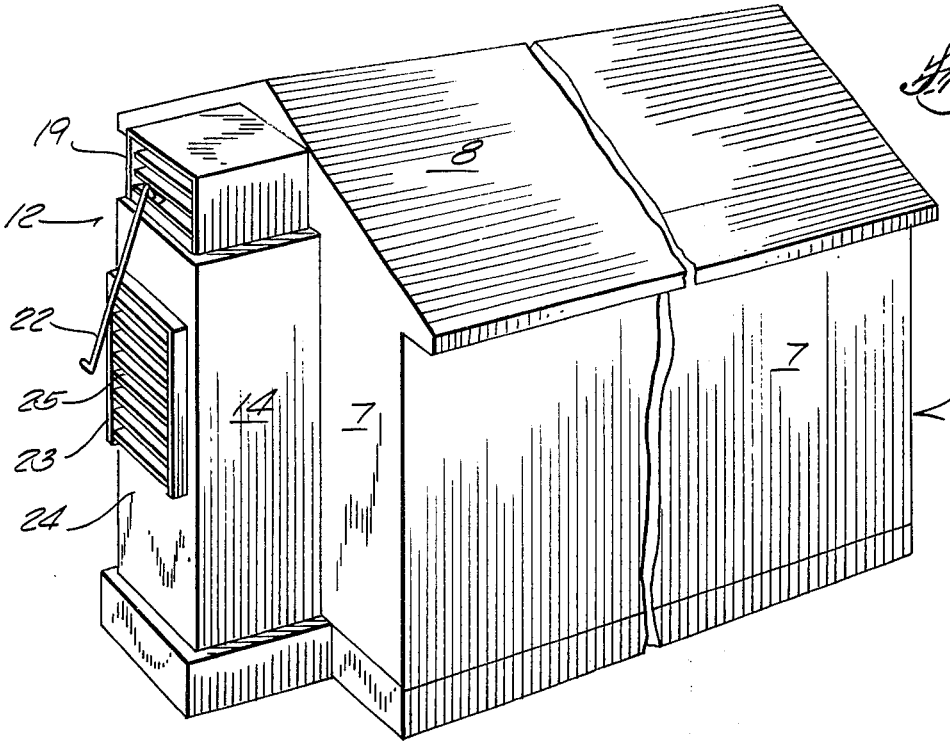
FIG. 1 is a perspective view of a tobacco curing barn with which there is associated curing and drying apparatus embodying the principles of this invention.

The apparatus by which the air entering the barn is heated and conditioned as to humidity is designated generally by the numeral 12. It includes a vertically oriented duct 14 mounted alongside one of the upright walls 7 of the barn (FIGS. 1 and 2), a heating unit 13 located in the lower portion of the duct, and an air circulating fan 15 that is also located in the duct, above the heating unit. Air entering the duct at its top leaves the duct through its bottom end, which is at all times communicated with the air inlet into the barn provided by a hole 7*b* in the adjacent wall of the barn that provides unrestricted communication between the duct and the space 11 beneath the perforated floor. All air flowing through the duct thus debouches into that space and flows from it through the perforations or slots in the floor 10.

The upper end of the duct is communicable with the ambient atmosphere and with the interior of the barn. For communication with the barn interior, the duct has a transversely disposed extension 16 which projects through the air outlet of the barn provided by a hole 7*u* in the adjacent wall of the barn and has its inner open end 17 located well within the uppermost portion of the barn interior. The opposite or outer end 18 of the transversely disposed duct extension 16 opens to the atmosphere. The transversely disposed extension 16, thus can be considered inlet means for the duct.

In the embodiment of the invention illustrated in FIG. 2, the air circulating fan 15 is mounted in the duct extension 16, near its open end 17, and hence is so located that it can draw air from all portions of the barn. During the different stages of the tobacco curing and drying process, the air withdrawn from the barn by the fan is either discharged into the atmosphere through the outer end 18 of the duct extension, is directed down into the vertical duct portion 14, or is directed partially into the atmosphere and partially into the duct portion 14. The relative proportions of recirculated and discharged air are controlled by the adjustment of two sets of louvers 19 and 20. The louvers 19 are located in the outer end portion of the duct extension 16; and the louvers 20 extend across the upper end of the vertical duct portion 14, between it and the duct extension 16, and hence control flow of air from the duct extension into the duct portion 14.

All of the louvers 19 and 20 are interconnected by links 21 so that they may be concomitantly adjusted either by a remotely controlled actuator (not shown) or by manual actuation of a handle 22. The manner in which the louvers are adjusted is not important, but the fact that one set thereof moves towards its closed position while the other moves towards its open position, and vice versa, is important. This interconnected relationship between the louvers 19 and 20 makes it possible to readily adjust the relative proportions of recirculated and discharged air. With the louvers in the positions shown in full lines in FIG. 2, all of the air drawn from the barn by by fan 15 is discharged.

It should of course be understood that the volume of air entering the bottom of the barn should equal the volume of air withdrawn from its top. Accordingly, as communication between the duct 14 and its extension 16 is reduced, other air must be brought into the duct portion 14. This is done by admitting ambient air at atmospheric pressure through an opening 23 in the front wall 24 of the vertical duct portion, under control of another set of adjustable louvers 25 mounted across the opening 23. Like the other louvers, the several louvers 25 are connected by linkage 26. As shown in FIG. 2, the louvers 25 are pivotally mounted at their upper edges so that they can swing freely between a closed position hanging substantially vertically downward and the inwardly swung open position in which they are shown in FIG. 2. Since FIG. 2 shows the louvers 19 and 20 adjusted to prevent recirculation, it follows that all of the air removed from the barn by the fan 15 must be replaced with fresh air, and since the discharge of heated air from the upper reaches of the barn creates a subatmospheric pressure in the duct portion 14, the louvers 25 automatically assume an open position in which they are shown in FIG. 2, to admit the required amount of fresh air. The volume of fresh air entering the duct portion 14 is thus automatically governed by the adjustment of the louvers 19 and 20.

By the comcomitant adjustment of the louvers, 19 and 20 the humidity of the air flowing through the vertical duct portion 14 and into the barn is controlled as required at the different stages of the curing and drying cycle. The temperature of that air must also be controlled. That is done by regulating the operation of the heating unit 13, which is located in the lower portion of the vertical duct portion 14.

The heating unit 13 comprises a forced draft oil burner 27 having an air intake port 28, an electric motor driven blower 29 and a nozzle or burner outlet 30 from which flame issues when the burner is in operation. The nozzle 30 opens downwardly into a combustion chamber 31 that is closed at its top by a dome-shaped refractory wall 31'. The combustion chamber is further defined by a stainless steel cylindrical shell 32, the upper edge of which connects with the periphery of the dome-shaped wall. In the bottom of this shell is a refractory target 33 against which the flame impinges. Since the target is smaller in diameter than the shell 32, it cooperates with the shell to define an annular exit 34 from the combustion chamber, through which the heated gases and products of combustion that result from operation of the burner enter the air stream flowing through the duct.

To protect the walls of the duct from the heat of the combustion chamber, a radiant heat shield 35 surrounds the shell 32. The heat shield is supported in the duct 14 in any suitable manner, as by arms 36 connected to the walls of the duct, as shown in FIG. 5; and the burner is seated on a shelf 37 that extends across the duct. The combustion chamber is suspended from the shelf 37 by conventional hanger straps (not shown) and held properly centered with the burner nozzle and the shield 35 in any suitable manner, as by arms (not shown) radiating from the shell 32 and attached to the shield 35.

As is conventional, a thermostat (not shown) located in the curing barn controls the burner for intermittent firing as required to maintain a predetermined temperature in the barn.

It is a feature of the present invention that the entire fuel burner 27, including the portion of it that defines its air intake port 28, is located in the duct 14, downstream of the air circulating fan 15. Because of this, the only air flowing through the burner is that which is flowing through the duct portion 14. Hence the air circulating fan 15, being upstream from the burner, tends to force air through the burner in the direction from its air intake port 28 toward the refractory target 33, and thereby tends to overcome the adverse pressure gradient which has heretofore posed the above discussed problems of low burner capacity and back draft immediately following burner shut-down.

The construction in the duct that is formed by the dome-shaped top wall 31' of the combustion chamber also plays an important role in affording unprecedented burner efficiency. Because of this constriction, the air being moved through the vertical duct portion 14 is in effect throttled, so that there is a marked pressure difference across the burner, with substantially higher pressure at the burner air intake port 28 than at the refractory target 33. Thus the constriction and throttling effect provided by the combustion chamber 31, in conjunction with the location of the burner wholly within the vertical duct portion 14, overcomes the adverse pressure gradient that would otherwise develop through the burner with the air circulating fan located upstream from it, assuring that the burner will operate at full capacity and that there will be no wasteful and potentially damaging back drafts after burner shut-down.

Figure 3:
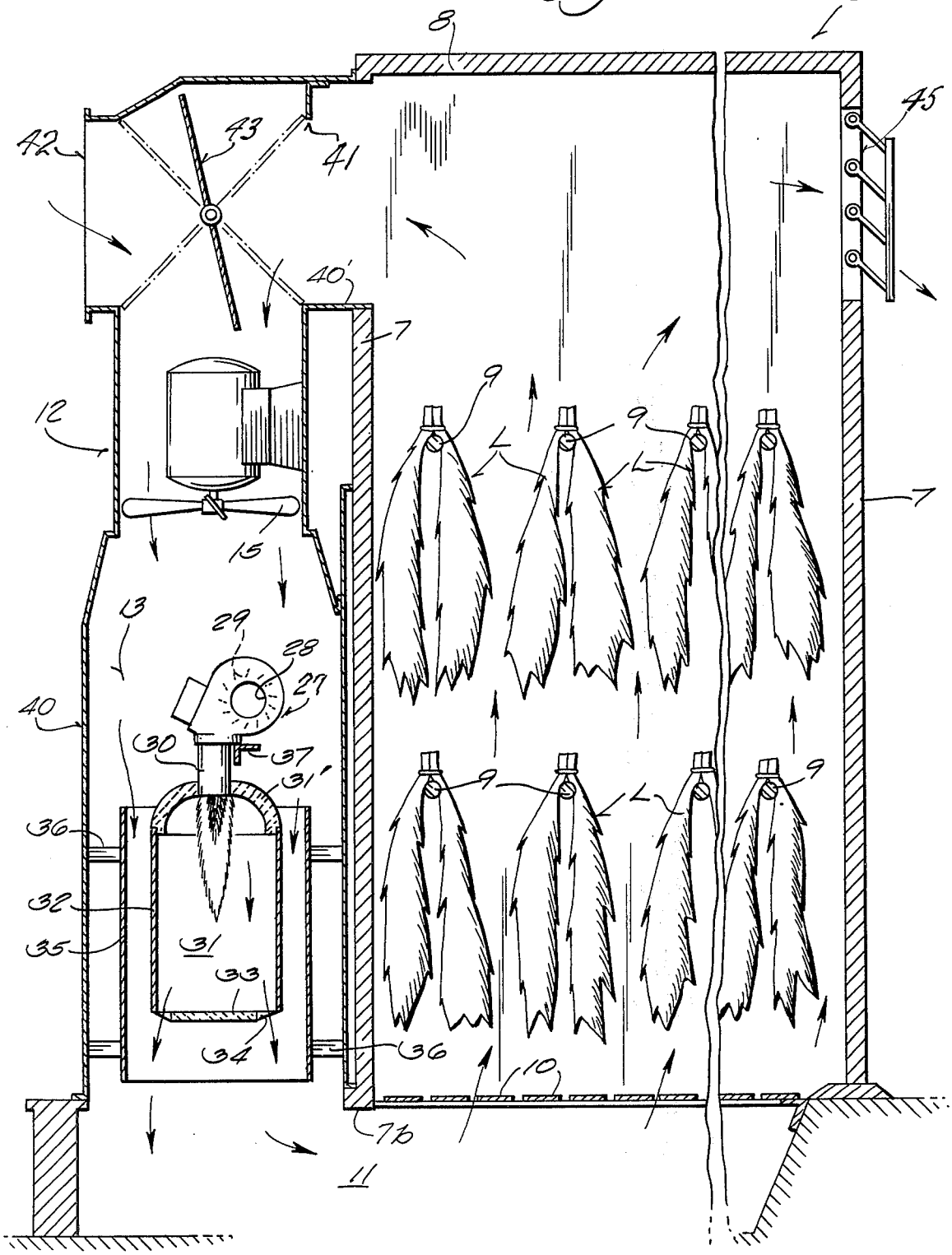
FIG. 3 is a vertical sectional view similar to FIG. 2, but illustrating a somewhat modified version of the curing and drying apparatus.

The modified version of the apparatus illustrated in FIG. 3 is especially suitable for situations in which the air circulating fan cannot be accommodated in the interior of the barn due to some aspect of the nature of construction of the barn. In this case the duct 40 in which the air circulating fan 15 and the burner 27 are located is oriented vertically throughout its entire length, and can thus be located wholly outside the barn. Its upper end portion is connected with the interior of the barn by a short lateral extension 40' which fits into the hole 7*u* and hence can be considered inlet means for the duct.

The duct 40 further differs from the duct 14, 16 of FIG. 2 in that it has no provision for the admission of ambient air downstream from the fan 15. Instead, the duct 40, at its top, has a lateral opening 41 at one side thereof through which it is communicated with the barn interior and has a lateral opening 42 at its opposite side through which it is communicated with the ambient atmosphere. The air circulating fan 15 is located in the duct 40 at a level below the openings 41 and 42 — but, of course, above the fuel burner 27. By means of a damper 43 that is adjustably mounted in the upper end portion of the duct 40, the air drawn into the duct by the fan can be selectively proportioned between air from the barn, for recirculation, and outside air to be added to the recirculated air. With the damper in one of its extreme positions of adjustment, only air from the barn reaches the fan, through the opening 41, and such air is therefore fully recirculated. In the other extreme position of the damper, only outside air is drawn into the system through the opening 42. When fresh air is drawn into the apparatus, a proportionate quantity of heated air must be exhausted from the barn. For this purpose a louvre-controlled vent or outlet 45 is provided. This vent can be at any suitable location in the upper portion of the barn, and as in the other embodiment of the invention illustrated in FIG. 2, its louvers 46 are linked together to move in unison towards their closed or open position in response to pressure differential inside and outside the barn. In other respects, the apparatus illustrated in FIG. 3 is the same as that of FIG. 2.

It should be apparent that while the invention has been described with specific reference to its application to the curing and/or drying of leaf tobacco, the invention is by no means limited in its utility to the processing of that product. It can be used to advantage for the curing or drying of such other crops as peanuts, sweet potatoes and corn. In fact, it would be advantageous in any situation where the relative humidity and temperature in an enclosed space are to be maintained at predetermined levels, and where the introduction of products of combustion into the enclosure can be tolerated.

Those skilled in the art will appreciate that the invention can be embodied in forms other than as herein disclosed for purposes of illustration.

The invention is defined by the following claim in which the term "processing" is used to avoid any possible vagueness or indefiniteness which might result from the phrase "and/or" in reference to use of the invention in the curing or drying of a product.

I claim:

1. A method of processing products such as tobacco, wherein the products to be processed are placed in an enclosure which has an inlet and an outlet and through which heated air is circulated from said inlet to said outlet, which method comprises:

A. communicating the outlet of the enclosure with the inlet of a duct that has its outlet communicated with the inlet of the enclosure;

B. effecting a positive circulation of air through the enclosure by drawing air from its outlet and forcing it into the duct to thereby create a zone of positive pressure in the duct near its inlet to force the air through the duct towards its outlet;

C. combusting fuel in the duct at a combustion zone located downstream of said zone of positive pressure;

D. supplying air for such combustion from a location in the duct between said zone of positive pressure and said combustion zone; and E. creating a pressure differential through the combustion zone in the direction to establish a lower pressure downstream of the combustion zone than that which obtains at the location in the duct from which the air for combustion is taken, whereby heat and gases resulting from the combustion are constrained to flow through the combustion zone in the direction of air flow through the duct, to thereby minimize the possibility of any substantial back draft through the combustion zone.

2. The method defined by claim 1, further characterized by:

F. venting air from the enclosure to the ambient atmosphere at a selected rate; and G. drawing make-up air into the duct from the ambient atmosphere.

3. Apparatus for processing products such as tobacco, by circulating heated air through an enclosure having an air inlet and an air outlet and in which the product being processed is so placed that the air being circulated through the enclosure from its inlet to its outlet can reach substantially all parts of the product, said apparatus comprising:

A. means defining a duct having an outlet connected with the air inlet of the enclosure;

B. air inlet means for said duct;

C. means for communicating said air inlet means with the air outlet of the enclosure, so that air leaving the enclosure can enter the duct;

D. air moving means having a suction side and a pressure side, located near said inlet means for effecting movement of air through the duct towards its outlet, and for concomitantly effecting circulation of air through the enclosure from its air inlet to its air outlet;

E. a forced draft fuel burner having a fan with a definitely defined air intake, to force air entering said intake through the burner, the burner also having a mouth from which flame and hot gases issue when the burner is in operation;

F. means mounting the fuel burner with its air intake communicating with the interior of the duct at a first zone thereof that is downstream of the pressure side of the air moving means and with its mouth debouching into the duct at a second zone thereof that is downstream of said first zone; and G. means forming a constriction in the duct between said first and second zones to cause air passing through the duct to have a substantially higher pressure at said first zone than at said second zone, and operable to constrain heat and hot gases issuing from the mouth of the fuel burner to flow therefrom only in the direction towards the outlet of the duct, and thereby eliminate the possibility of any substantial back draft through the burner whether it is in operation or not.

4. The apparatus of claim 3, further characterized by:

1. the fuel burner being located wholly within the duct; and 2. means defining a combustion chamber in which combustion of fuel takes place and which combustion chamber is located in the duct and coacts with the walls of the duct to define said constriction.

5. The apparatus of claim 3 wherein said air inlet means is communicable with the ambient atmosphere as well as with the air outlet of the enclosure, and further characterized by:

G. air flow directing means operatively associated with said air inlet means and comprising adjustable damper means for selectively proportioning the relative amounts of air flowing into the air inlet means from the enclosure and from the ambient atmosphere; and H. means defining an outlet from the enclosure through which a portion of the air circulating through the enclosure and equivalent to the volume of ambient air flowing into the air inlet means, can be vented to the atmosphere.

6. The apparatus of claim 3, further characterized by:

G. means defining a heated air outlet through which heated air can leave the enclosure;

H. means defining an ambient air entry into the elongated duct through which fresh air can enter the duct; and I. adjustable flow controlling means by which the volume of fresh air entering the duct and the volume of heated air discharged from the enclosure can be correlated.

7. The apparatus of claim 3, further characterized by:

G. means defining a heated air outlet from said air inlet means through which heated air leaving the enclosure by way of said air inlet means can be discharged to the atmosphere;

H. adjustable flow controlling means at the junction of said air inlet means with the elongated duct by which the admission of air leaving the enclosure and entering the duct for recirculation can be regulated;

I. adjustable flow controlling means at the heated air outlet by which the discharge of heated air into the atmosphere can be regulated;

J. means interconnecting said two flow controlling means to constrain the same to concomitant adjustment with one thereof moving towards closure while the other moves towards its open condition, and vice versa;

K. means for selectively effecting such adjustment of said two flow controlling means to thereby proportion the air leaving the enclosure between entry of said air into the duct and discharge thereof to the atmosphere;

L. means defining an ambient air inlet into the duct downstream of said air inlet means through which ambient air may be drawn into the duct to replace the heated air discharged into the atmosphere; and M. damper means at said ambient air inlet by which flow therethrough is coordinated with the adjustment of said two flow controlling means.

8. The apparatus of claim 3, wherein the air outlet from the enclosure is also communicable with the ambient atmosphere, and further characterized by:

G. adjustable air flow controlling means to proportion the air leaving the enclosure between entry thereof into the duct and discharge thereof into the ambient atmosphere;

H. means defining an ambient air inlet into the duct downstream of the inlet means through which air may be drawn into the duct; and I. damper means at said ambient air inlet to correlate the passage of ambient air therethrough with the volume of air discharged into the ambient atmosphere.

9. The apparatus of claim 8, wherein said means defining the elongated duct has a vertically oriented part thereof alongside an exterior wall of the enclosure, and a horizontally oriented extension leading from the upper end of said vertically oriented part and passing through said wall of the enclosure, said extension having an outer end contiguous to the top of the vertically oriented part of the duct and an inner end that opens to the interior of the enclosure near the top thereof, and wherein the air moving means is a blower located in said horizontal extension of the duct.

10. The apparatus of claim 8, further characterized by:

1. the fuel burner being located wholly within the duct so that its air intake can receive air only from the interior of the duct, and
2. means defining a combustion chamber in which combustion takes place and which combustion chamber is located in the duct and by its placement therein forms said constriction.

11. The apparatus of claim 10, wherein said combustion chamber has a closed end into which the mouth of the burner debouches and an opposite open end communicating with the duct interior.

12. The apparatus of claim 9, wherein the fuel burner is located within the vertically oriented part of the duct so that its air intake can receive air only from the interior of said vertically oriented part of the duct, and wherein said ambient air inlet is in a wall of said vertically oriented part of the duct and so positioned with respect to the air intake of the burner that air entering said ambient air inlet can be drawn into the air intake of the burner.

13. The apparatus of claim 9, wherein the outer end of said horizontally oriented duct extension opens to the atmosphere;

wherein said adjustable flow controlling means by which the air leaving the enclosure is proportioned between discharge to ambient atmosphere and continued flow through the duct comprises 1. damper means at the outer end of said horizontally oriented extension,
2. damper means at the junction of the vertically oriented part of the duct with its horizontal extremity, and
3. linkage connecting said two damper means by which opening of one is accompanied by closure of the other and vice versa, and wherein said ambient air inlet is located in a wall of the vertically oriented part of the duct.

14. Apparatus of the type adapted for association with an enclosure in which products such as tobacco can be so arranged that heated air of regulated relative humidity circulated through the enclosure can contact substantially all portions of the product, and which apparatus has 1. a fuel burner for heating the air to be circulated through the enclosure, which fuel burner has a definitely defined air intake and a discharge mouth from which flame and hot gases issue when the burner is in operation, and
2. blower means having a suction side and a pressure side for effecting circulation of heated air and hot combustion gases issuing from the fuel burner, through the enclosure, said apparatus being characterized by:

A. a duct having inlet means and outlet means both communicable with the interior of the enclosure so that air drawn into the duct from the enclosure by the blower means flows towards the outlet means of the duct;

B. the fuel burner being of the forced draft type and having a fan to force air for combustion through the burner, and having its said air intake communicating with the duct interior at a defined location and its discharge mouth debouching into the duct downstream from said defined location;

C. the blower means being located in the duct between its inlet means and said defined location, with its suction side facing the inlet means and its pressure side upstream of said defined location and facing the outlet means of the duct; and D. means defining a restriction in the duct between said defined location and the point at which the discharge mouth of the burner debouches into the duct to thereby effect a pressure differential in the duct by which the air flowing through the duct is at a lower pressure at said point than it is at said defined location in the duct, so that heat and gases issuing from the mouth of the burner are constrained to flow through the duct in the direction towards its outlet means, and the possibility of any substantial back draft through the burner is prevented whether the burner is in operation or not.

15. The apparatus of claim 14, further characterized by:

E. said inlet means of the duct being communicable with the ambient atmosphere so that the blower means can draw fresh air into the duct along with heated air being recirculated therethrough from the enclosure;

F. adjustable damper means operatively associated with said inlet means for controlling the proportions of fresh and heated recirculated air flowing through the duct;

G. means defining a heated air vent leading from the enclosure and through which heated air can leave the enclosure; and H. damper means at said heated air vent by which the volume of heated air leaving the enclosure can be correlated with the volume of fresh air drawn into the duct.

* * * * *